United States Patent [19]

Strindehag et al.

[11] 4,035,172

[45] July 12, 1977

[54] REGENERATIVE HUMIDITY AND HEAT EXCHANGE APPARATUS

[75] Inventors: Ove Strindehag; Erik Wrangel, both of Jonkoping, Sweden

[73] Assignee: Aktiebolaget Svenska Flaktfabriken, Nacka, Sweden

[21] Appl. No.: 651,588

[22] Filed: Jan. 22, 1976

[30] Foreign Application Priority Data

Jan. 30, 1975 Sweden ..... 7500986

[51] Int. Cl.[2] ..... B01D 53/16

[52] U.S. Cl. ..... 55/388

[58] Field of Search ..... 55/30, 34, 80, 163, 55/208, 388; 62/54, 94, 271; 261/94–98; 165/7

[56] References Cited

U.S. PATENT DOCUMENTS

| | | | |
|---|---|---|---|
| 2,038,071 | 4/1936 | Wilhelm | 55/388 X |
| 2,134,544 | 10/1938 | Ashley | 55/34 X |
| 2,792,071 | 5/1957 | Pennington | 55/34 X |
| 2,944,957 | 7/1960 | Keidel | 55/163 X |
| 3,296,773 | 1/1967 | Hemstreet | 55/208 X |
| 3,400,515 | 9/1968 | Ackerman | 55/388 X |
| 3,782,081 | 1/1974 | Munters | 55/388 X |

*Primary Examiner*—Thomas G. Wyse
*Assistant Examiner*—Robert H. Spitzer
*Attorney, Agent, or Firm*—Howson and Howson

[57] ABSTRACT

A surface layer is formed on transfer elements of the rotor of a humidity and heat exchanger rotor, the layer not only being hygroscopic to provide the desired humidity transfer, but also serving as a bonding agent or cement for holding the transfer elements together in the desired rotor configuration. A preferred layer uses as a bonding agent a solution of cellulose acetate or nitrate in acetone, and with lithium chloride dissolved therein to produce the hygroscopic effect.

4 Claims, 3 Drawing Figures

REGENERATIVE HUMIDITY AND HEAT EXCHANGE APPARATUS

Subject matter related to that described and claimed herein, is described and claimed in my copendng application Ser. No. 651,589, filed concurrently herewith and entitled *HUMIDITY AND HEAT EXCHANGER APPARATUS, AND METHOD FOR ITS MANUFACTURE.*

The present invention relates to a humidity and heat exchange apparatus, especially of the regenerative type.

Regenerative heat exchangers have long been used for the recovery of heat in ventilation installations because such heat exchangers possess a relatively high thermal efficiency. Regenerative heat exchangers in addition can accomplish a transfer of humidity, which can be especially valuable in zones with cold climate. The hitherto most commonly used type of regenerative heat exchanger in ventilation installations for the exchange of heat betweean the warm discharge air flow and the cold intake air flow is the rotating heat exchanger with a disc-shaped rotor. The heat exchange rotor is usually constructed of alternating flat and corrugated panels or foils made of metal, paper, or asbestos. In another commonly used model the rotor is constructed of a 3 -dimensional network of metal wires.

Rotating heat exchangers with a heat exchanger body consisting of panels or of a network made of non-hygroscopic material, for example of metal, accomplish the transfer of humidity only by the condensation of water vapor. Such heat exchangers thus produce a less efficient transfer of humidity than exchangers made of hygroscopic material for example paper or asbestos. But heat exchangers with metal rotors have, in comparison with rotors made of paper, the clear advantage of being fire-proof, and in ventilation installations metal is preferable to asbestos for medical reasons.

The low effectiveness of non-hygroscopic humidity and heat exchangers in the tranfers of humidity thus constitutes a clear disadvantage, and in addition there is the problem that the transfer elements which accomplish heat and humidity exchange in conventional exchangers must be assembled in one or in several special work procedures required exclusively for this purpose.

A principal object of the invention is to construct a humidity and heat exchanger which primarily is made of non-hygroscopic material, which is nevertheless very effective in transferring humidity, yet requires fewer manufacturing steps, and is less expensive.

This object is achieved according to the invention in the manner set forth in the following description and in the appended claims. An efficient transfer of humidity is achieved while avoiding the fire safety and health requirements mentioned above and while achieving a simpler and less expensive assembly procedure; this represents a considerable improvement over heat exchangers of the hitherto used types.

The invention is described herein with particular reference to a heat exchanger rotor employing alternating flat and corrugated panels or foils equipped with special spacers which create continuous channels passing through the body. By bilateral treatment of the flat and corrugated panels or foils, the humidity transfer surface of the transfer elements of the heat exchanger becomes equally as large as the heat transfer surface, which means that only small quantities of humidity need be absorbed or released per unit area. Normally humidity is absorbed in the warm, released in the cold air stream. The circumstance that only small quantities of humidity need be transferred per area unit permits the use of thin hygroscopic layers on a non-hygroscopic substrate, for example on metal. My above-identified copending application describes and claims such a construction and methods for manufacturing it. According to the present invention, the hygroscopic surface layer is provided on the non-hygroscopic substrate of the transfer elements, wherein the layer is not only hygroscopic but also serves as a bonding agent to hold the transfer elements in position in the assembly. Preferably the layer is a thin deposit of a true solution consisting of a hygroscopic salt and an organic bonding agent. In this manner the surface layer both transfers humidity effectively and serves as a bonding agent for the joining of the heat exchanger body, and thus serves a double purpose. In a preferred embodiment the organic bonding agent comprises a solution of cellulose acetate or nitrate in acetone. A solution of this bonding agent, saturated with a hygroscopic salt, for example with lithium chloride, can easily absorb the quantity of water for the stated purpose. The bonding agent likewise fully meets the requirements of cohesion and of mechanical strength required in the joining of the heat exchanger body.

As already intimated, the heat exchanger body can be constructed in a variety of ways. The application of the surface treatment procedure according to the invention will be illustrated here by one sole example, i.e. for the very common case of a heat exchanger body with a rotor consisting of alternating flat and corrugated foils, as shown in the drawings, wherein.

Figure 1:
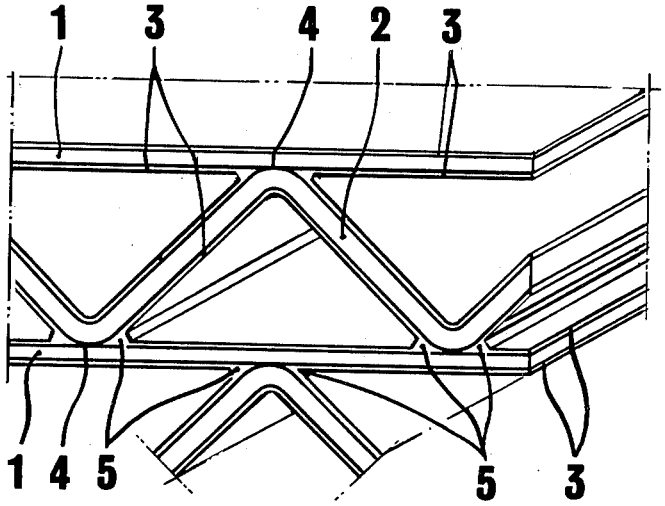
FIG. 1 is an enlarged fragmentary side view of a portion of a rotor constructed of alternating flat and corrugated foils.
Figure 2:
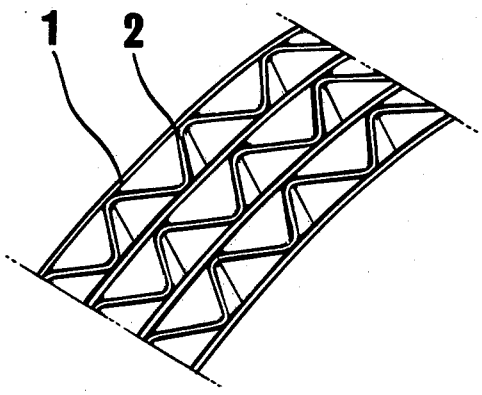
FIG. 2 is a less-enlarged fragmentary view of a larger segment of the same rotor.
Figure 3:
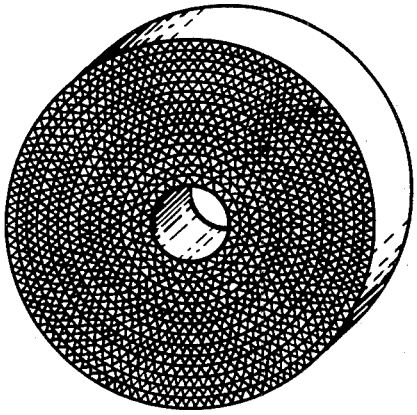
FIG. 3 is a perspective view of the entire rotor.

FIG. 1 reveals that the flat foils 1 and the corrugated foils 2 are bilaterally coated with a surface layer 3 as described above, and having both hygroscopic and bonding properties. Thus adhesive joints 5 are formed at contact points 4 of the foils, by means of which the flat foils are attached to the corrugated ones, yielding a mechanically stable rotor.

Compact rotor structures are usually used in rotating heat exchangers for heat recovery in ventilation installations where the rotor is constructed of alternating flat and corrugated foils and where the division, i.e. the distance between the center lines of the flat foils, normally is 0.05 to 0.2 mm.

In the construction of a surface layer whose double task according to the invention is to serve as a vehicle for the transfer of humidity and as a bonding agent designed to join the rotor together, an advantageous surface layer thickness is 1–10 microns in view of the desirabliity of keeping the pressure drop of the passing ventilated air from rising markedly. When the surface layer consists of a deposit of a saturated solution of lithium chloride with cellulose acetate, then layers of this thickness will achieve both the desired transfer of humidity as well as an adequately effective bonding of the rotor.

While the invention has been described with particular reference to specific embodiments in the interest of definiteness, it will be understood that it may be embodied in a variety of forms diverse from those specifically shown and described, without departing from the spirit and scope of the invention as defined by the appended claims.

What is claimed is:

1. Humidity and heat exchange apparatus comprising an assembly of transfer elements for the exchange of heat and humidity between two different zones of fluid between which said transfer elements move, wherein said transfer elements consist of an interior non-hygroscopic material and a surface layer of a hygroscopic material which serves as a bonding substance cementing said elements to each other in said assembly, said hygroscopic layer comprising a true solution of a hygroscopic salt and an organic bonding agent, whereby said cementing and application of said surface layer are accomplished effectively and without requiring special heating of said surface layer to temperatures at which said bonding agent would be burned off.

2. The apparatus of claim 1, wherein said hygroscopic salt is lithium chloride and said organic bonding agent is selected from the group consisting of cellulose acetate and cellulose nitrate.

3. The apparatus of claim 1, wherein said non-hygroscopic material is a metal, and said transfer elements are panels or foils.

4. The apparatus of claim 1, wherein the thickness of said layer is from 1 to 10 microns.

* * * * *